US006902461B1

(12) United States Patent
Munch et al.

(10) Patent No.: US 6,902,461 B1
(45) Date of Patent: Jun. 7, 2005

(54) MICROPROCESSOR CONTROLLED TOY BUILDING ELEMENT WITH VISUAL PROGRAMMING

(75) Inventors: Gaute Munch, Langå (DK); Jesper Rasmussen, Bredsten (DK)

(73) Assignee: Interlego AG, Baar (CH)

( * ) Notice: Subject to any disclaimer, the term of this patent is extended or adjusted under 35 U.S.C. 154(b) by 0 days.

(21) Appl. No.: 09/890,733

(22) PCT Filed: Feb. 4, 2000

(86) PCT No.: PCT/DK00/00051

§ 371 (c)(1),
(2), (4) Date: Sep. 24, 2001

(87) PCT Pub. No.: WO00/45924

PCT Pub. Date: Aug. 10, 2000

(30) Foreign Application Priority Data

Feb. 4, 1999 (DK) ..... 1999 00143 U

(51) Int. Cl.[7] ..... A63H 33/04
(52) U.S. Cl. ..... 446/91; 446/85
(58) Field of Search ..... 446/95, 454, 456, 446/436, 465, 85, 91, 93, 175; 545/122, 157, 474; 463/36, 57, 39

(56) References Cited

U.S. PATENT DOCUMENTS 4,712,184 A * 12/1987 Haugerud ..... 446/95
4,802,879 A 2/1989 Rissman et al.
5,724,074 A 3/1998 Chainani et al.
5,908,345 A 6/1999 Choi

FOREIGN PATENT DOCUMENTS

| | | |
|---|---|---|
| EP | 0 930 595 A1 | 7/1999 |
| WO | WO 90/02983 | 3/1990 |
| WO | WO 98/21649 | 5/1998 |
| WO | WO 98/50872 | 11/1998 |

OTHER PUBLICATIONS

Definition of Integrate, The American Heritage Dictionary of the English Language, Third Edition, copyright 1992 by Houghton Mifflin Company.*

* cited by examiner

*Primary Examiner*—Mark Sager
(74) *Attorney, Agent, or Firm*—Pitney Hardin LLP

(57) ABSTRACT

A programmable toy comprising a microprocessor which can execute instructions in the form of program stored in a memory; a display integrated in the toy. The microprocessor is adapted to control electrical and/or electro-mechanical units in response to the instructions, said microprocessor being adapted to receive signals from electrical and/or electro-mechanical units. The display comprises a plurality of icons which each represent instructions for the microprocessor, and which can be activated by a user for programming of the microprocessor. The toy can hereby be programmed by means of a visual user interface.

32 Claims, 6 Drawing Sheets

MICROPROCESSOR CONTROLLED TOY BUILDING ELEMENT WITH VISUAL PROGRAMMING

BACKGROUND OF THE INVENTION

1. Field of the Invention

This invention relates to a microprocessor controlled toy building element comprising a microprocessor which can execute instructions in the form of a program stored in a memory; a display integrated in the toy; coupling means for coupling with building elements which can be moved by manoeuvring means, said manoeuvring means being controllable in response to the instructions.

2. Description of the Prior Art

In connection with the development of small, sophisticated and relatively inexpensive microprocessors it has become attractive to use these in many different consumer products—including toys. Generally, the development of toys has proceeded from simple functions such as playing of sounds in dolls, performance of simple patterns of movement in robots, etc., to the development of toys with sophisticated behaviour. The sophisticated behaviour can be recognized by a child playing with the toy and give the impression of a kind of personality. Particularly in connection with construction toys there are many possibilities of giving the toy a behaviour by combining program steps for a microprocessor controlled toy building element with a self-built mechanical structure.

Such programmable construction toys are known from the product ROBOTICS INVENTION SYSTEM from LEGO MINDSTORMS, which is a toy which can be programmed by a computer to detect a plurality of physical signals and to respond to these signals by implementing physical actions. The toy may e.g. be incorporated as a component in a vehicle by combining the toy with other toy building elements, e.g. motors, wheels, collision detectors and light detectors. Wo 90/02983 relates to a robot toy element which is controlled by a microprocessor and which can be programmed via an incorporated keyboard. The robot toy element can move according to patterns of movement and respond to external influences.

U.S. Pat. No. 5,724,074 is an example of a toy element which can be programmed. The toy element can be programmed from an external computer by means of a graphic user interface.

The above-mentioned principles of programming toy elements, however, are inexpedient for use in microprocessor controlled toy building elements. Particularly when the microprocessor controlled toy building elements can be coupled with other building elements to form a structure which can perform a pattern of movement, which depends partly on the structure and partly on the program performed by the microprocessor controlled toy building element. In such a situation, a change in the structure after it has been programmed may result in a structure which does not work. This is evident to adults, but to children who play in an intuitive—and partly unstructured—way, this will none the less be a typical situation. The known toy cannot handle such situations in a satisfactory manner.

In view of the prior art in the field, it is a problem that the programming and control facilities for microprocessor controlled toy building elements are insufficient.

BRIEF SUMMARY OF THE INVENTION

Accordingly, an object of the invention is to provide improved programming and control facilities for such microprocessor controlled toy building elements.

This is achieved when the microprocessor controlled toy building element mentioned initially is characterized in that the display comprises a plurality of icons which each represent instructions for the microprocessor, and which can be activated by a user for programming of the microprocessor, and by signalling with a first one of the plurality of icons, said first icon representing instructions which the microprocessor is executing.

This ensures that the user of the toy receives an indication of which instructions, rules or program steps the microprocessor is programmed to execute—and executes while signalling with the icon. This makes it easy for the child to proceed by the method of trial and error and get assistance in finding errors, if any, in the program or in the structure.

It is thus possible to program a toy element in a simple manner. It is moreover possible to make the toy element perform sophisticated functions based on a few and intuitive activations from a user.

BRIEF DESCRIPTION OF THE SEVERAL OBJECTS OF THE DRAWINGS

A preferred embodiment of the invention will be described below with reference to the drawing, in which FIG. 1 shows a block diagram of a programmable toy element;

FIG. 2 shows a display on a toy element;

FIG. 3*a* shows a first diagram of a state machine for visual programming of a toy element;

FIG. 3*b* shows a second diagram of a state machine for visual programming of a toy element;

FIG. 3*c* shows a third diagram for interrupting a state machine;

FIG. 3*d* shows a fourth diagram for starting a state machine;

DETAILED DESCRIPTION OF THE INVENTION

Figure 1:
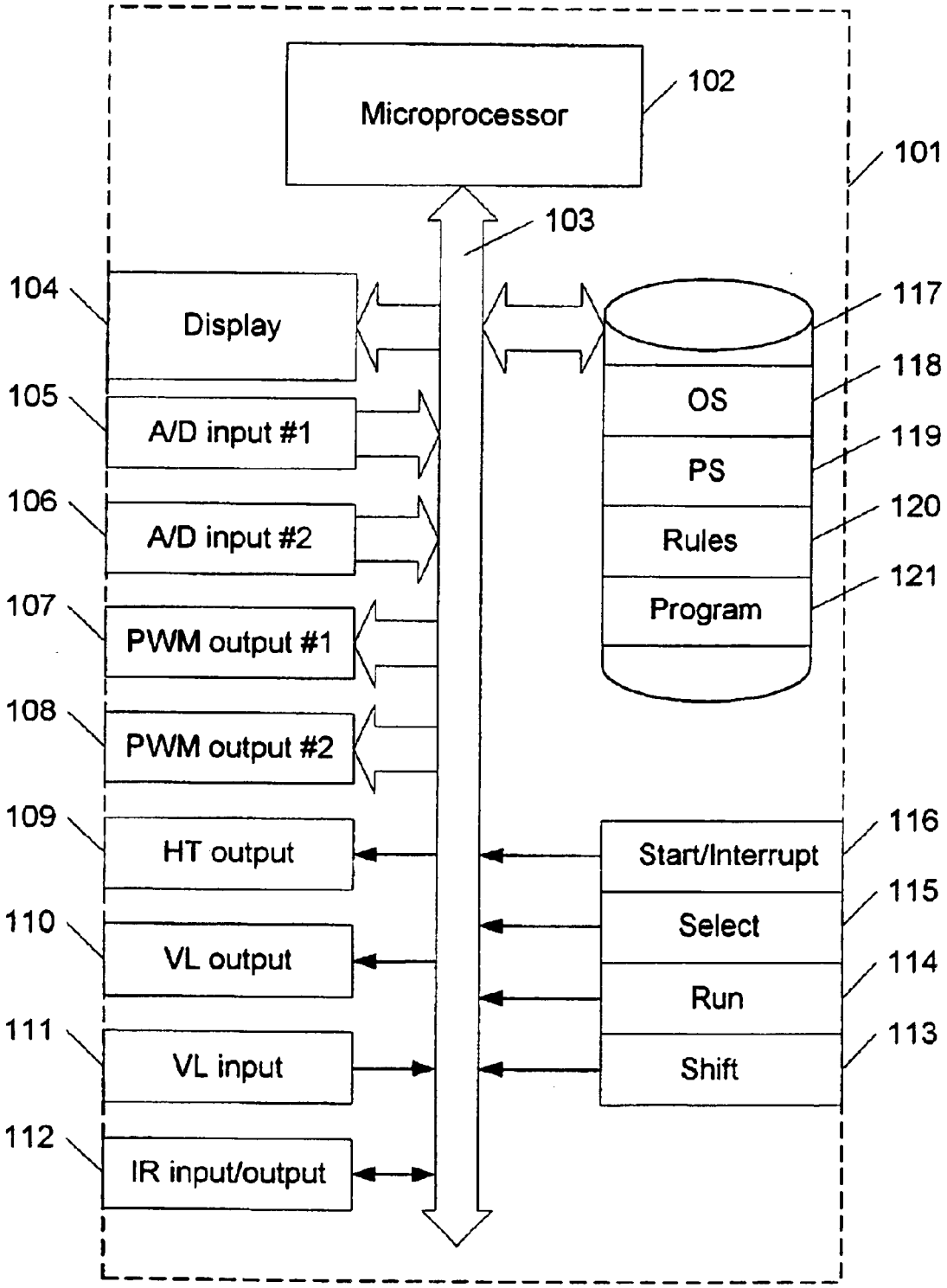

FIG. 1 shows a block diagram of a programmable toy element. The toy element 101 comprises a plurality of electronic means for programming the toy element so that it can affect electronic units (e.g. motors) in response to signals picked up from various electronic sensors (e.g. electrical switches).

The toy element may hereby be caused to perform sophisticated functions such as e.g. action controlled movement, provided that the toy element is combined with the electronic units/sensors in a suitable manner.

The toy element 101 comprises a microprocessor 102 which is connected to a plurality of units via a communications bus 103. The microprocessor 102 can receive data via the communications bus 103 from two A/D converters "A/D input #1" 105 and "A/D input #2" 106. The A/D converters can pick up discrete multibit signals or simple binary signals. Further, the A/D converters are adapted to detect passive values such as e.g. ohmic resistance.

The microprocessor 102 can control electronic units such as e.g. an electric motor (not shown) via a set of terminals "PWM output #1" 107 and "PWM output #2" 108. In a preferred embodiment of the invention the electronic units are controlled by a pulse width modulated signal.

Moreover, the toy element can emit sound signals or sound sequences by controlling a sound generator 109, e.g. a loudspeaker or piezoelectric unit.

The toy element can emit light signals via the light source "VL output" 110. These light signals can be emitted by means of light emitting diodes. The light emitting diodes may e.g. be adapted to indicate various states of the toy element and the electronic units/sensors. The light signals may furthermore be used as communications signals for other toy elements of a corresponding type. The light signals may e.g. be used for transferring data to a second toy element via a light guide.

The toy element can receive light signals via the light detector "VL input" 111. These light signals may be used inter alia for detecting the intensity of the light in the room in which the toy element is present. The light signals may alternatively be received via a light guide and represent data from a second toy element or a personal computer. The same light detector may thus have the function of communicating via a light guide and of serving as a light sensor for detecting the intensity of the light in the room in which the toy element is present.

In a preferred embodiment, the "VL input" 111 is adapted to selectively either communicate via a light guide or alternatively to detect the intensity of the light in the room in which the toy element is present.

Via the infrared light detector "IR input/output" 112 the toy element can transfer data to other toy elements or receive data from other toy elements or e.g. a personal computer.

The microprocessor 102 uses a communications protocol for receiving or transmitting data.

The display 104 and the keys "shift" 113, "run" 114, "select" 115 and "start/interrupt" 116 constitute a user interface for operating/programming the toy element. In a preferred embodiment, the display is an LCD display that can show a plurality of specific icons or symbols. The appearance of the symbols on the display may be controlled individually, e.g. an icon may be visible, be invisible and be caused to flash.

By affecting the keys the toy element may be programmed at the same time as the display provides feedback to a user about the program which is being generated or executed. This will be described more fully below. As the user interface comprises a limited number of elements (that is a limited number of icons and keys), it is ensured that a child who wants to play with the toy will quickly learn how to operate it.

The toy element also comprises a memory 117 in the form of RAM and ROM. The memory contains an operating system "OS" 118 for control of the basic functions of the microprocessor, a program control "PS" 119 capable of controlling the execution of user-specified programs, a plurality of rules 120, each rule consisting of a plurality of specific instructions for the microprocessor, and a program 121 in RAM which utilizes the specific rules.

In a preferred embodiment, the toy element is based on a so-called single chip processor which comprises a plurality of inputs and outputs, a memory and a microprocessor in a single integrated circuit.

In a preferred embodiment, the toy element comprises light emitting diodes which can indicate the direction of revolution of connected motors.

In a further embodiment, the toy element comprises incorporated manoeuvring means in the form of e.g. one or more motors with take-off in the form of shafts that are driven by the motors, or in the form of coupling holes with means for receiving part of a shaft and rotating this shaft.

Figure 2:
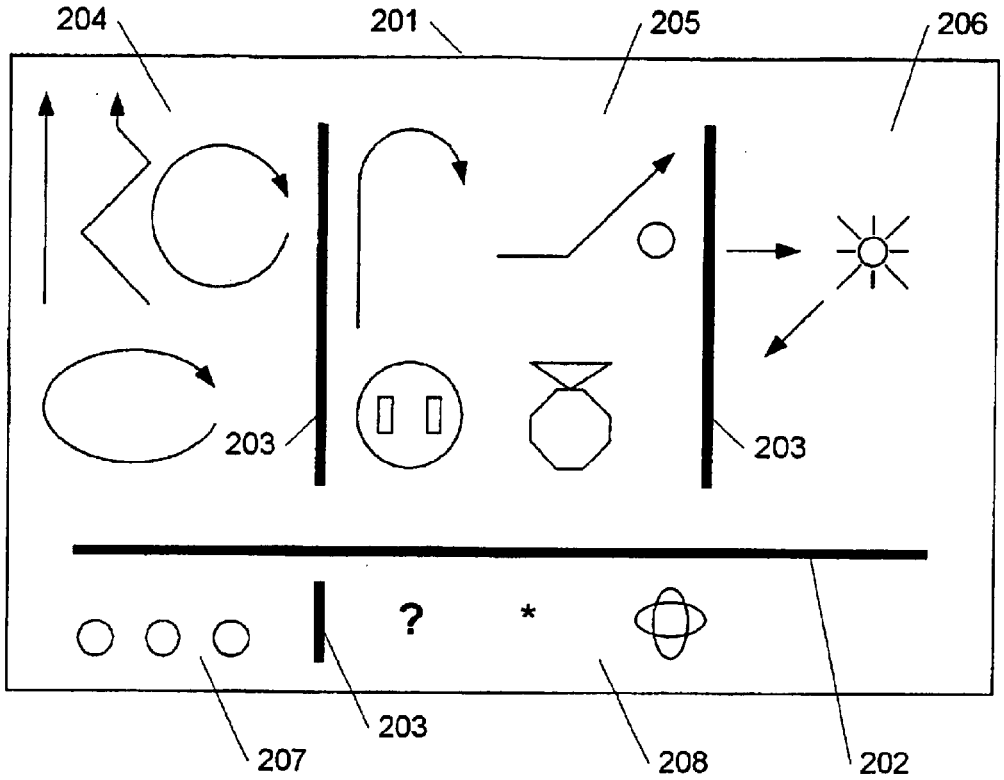

FIG. 2 shows a display on a toy element. The display 201 is adapted to show a plurality of specific icons and is shown in a state in which all the icons have been made visible. The icons are divided by horizontal and vertical beams 202 and 203, respectively, into a plurality of groups 204, 205, 206, 207 and 208 according to their function.

The icons may e.g. be designed to illustrate possible patterns of movement for a vehicle. A vehicle may e.g. be constructed by combining the toy element with two motors which can drive a set of wheels at the right-hand side and the left-hand side, respectively, of a vehicle. The vehicle may hereby be controlled to drive forwards, backwards, to the left and to the right. Further, the vehicle may comprise pressure-sensitive switches for detecting collision and light-sensitive sensors.

The group 204 includes icons for a straight and forwardly directed pattern of movement, a forwardly directed zigzag pattern of movement, a circular movement and a movement which repeats a given pattern. These patterns of movement are not conditioned by the action of sensors and are therefore unconditioned.

The group 205 includes a first icon for a pattern of movement, which is reversed when an obstacle is detected. A second icon shows a straight and forwardly directed pattern of movement, where the forwardly directed movement is merely corrected by the detection of an obstacle. A third icon conditions initiation of a pattern of movement. A fourth icon stops an ongoing pattern of movement when a pressure sensor is activated. The icons in the group 205 thus represent patterns of movement which are conditioned by pressure-sensitive sensors.

The group 206 includes icons for starting a pattern of movement which moves toward the strongest light intensity and a pattern of movement which moves toward the weakest light intensity, respectively. The light intensity is detected by means of light-sensitive sensors. The icons in the group 205 thus represent patterns of movement which are conditioned by light-sensitive sensors.

The group 207 includes three identical icons which can be displayed in combination to indicate the time constant at which the mentioned patterns of movement are to be performed. For example, the zigzag pattern may be modified by stepwise changing the period of time which has to elapse before the direction is changed. The time constant may e.g. be 2 seconds, 4 seconds and 7 seconds.

The group 208 comprises icons which represent a plurality of special effects. These effects may e.g. comprise emission of various sound and light signals optionally combined with an arbitrary activation of the mentioned patterns of movement.

It should be noted that the display may be of LCD type, LED type or another type. The display may moreover be adapted to show various forms of text messages. Icons may also be text.

Figure 3A:
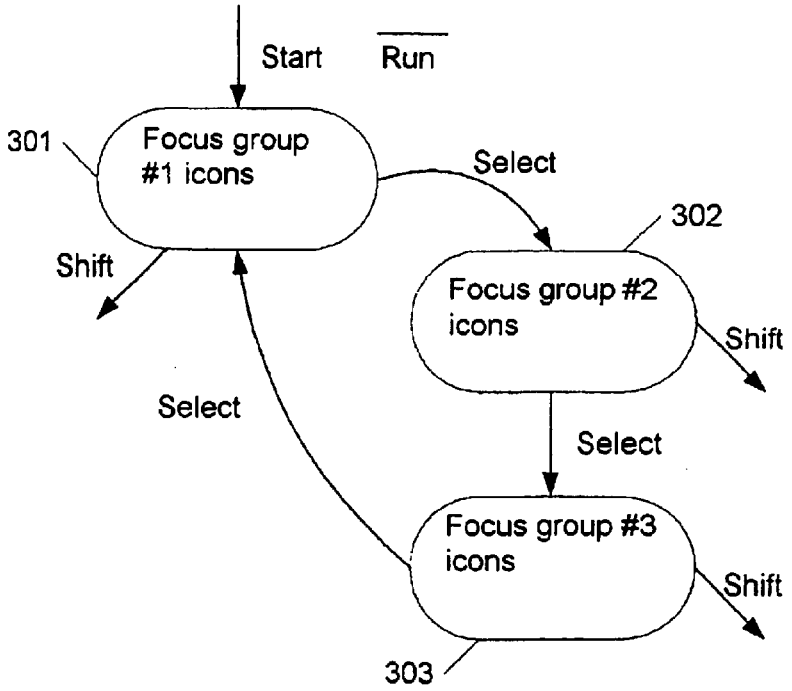

FIG. 3*a* shows a first diagram of a state machine for visual programming of a toy element. The state machine is implemented as a program which can be executed by the microprocessor 102. When the state machine does not execute a user-specified program, and when the toy element has been turned on, activation of the key "select" will direct focus from one group of icons to another group of icons. That a group of icons is in focus may be shown by flashing an icon in a group or all the icons in a group. The state machine shown comprises three states 301, 302 and 303 corresponding to switching focus between three different groups of icons.

The state machine changes states when the keys "select" or "shift" are activated. When the key "select" is activated, switching takes place between the states 301, 302 and 303. When the key "shift" is activated, the state machine continues in another set of states shown in FIG. 3*b*.

It should be noted that just three states are indicated in this program, corresponding to three groups of icons on the display 201. This has been chosen in order to make the diagram readily understandable. In practice, there must be a number of states corresponding to the number of groups of icons on the display.

Figure 3B:
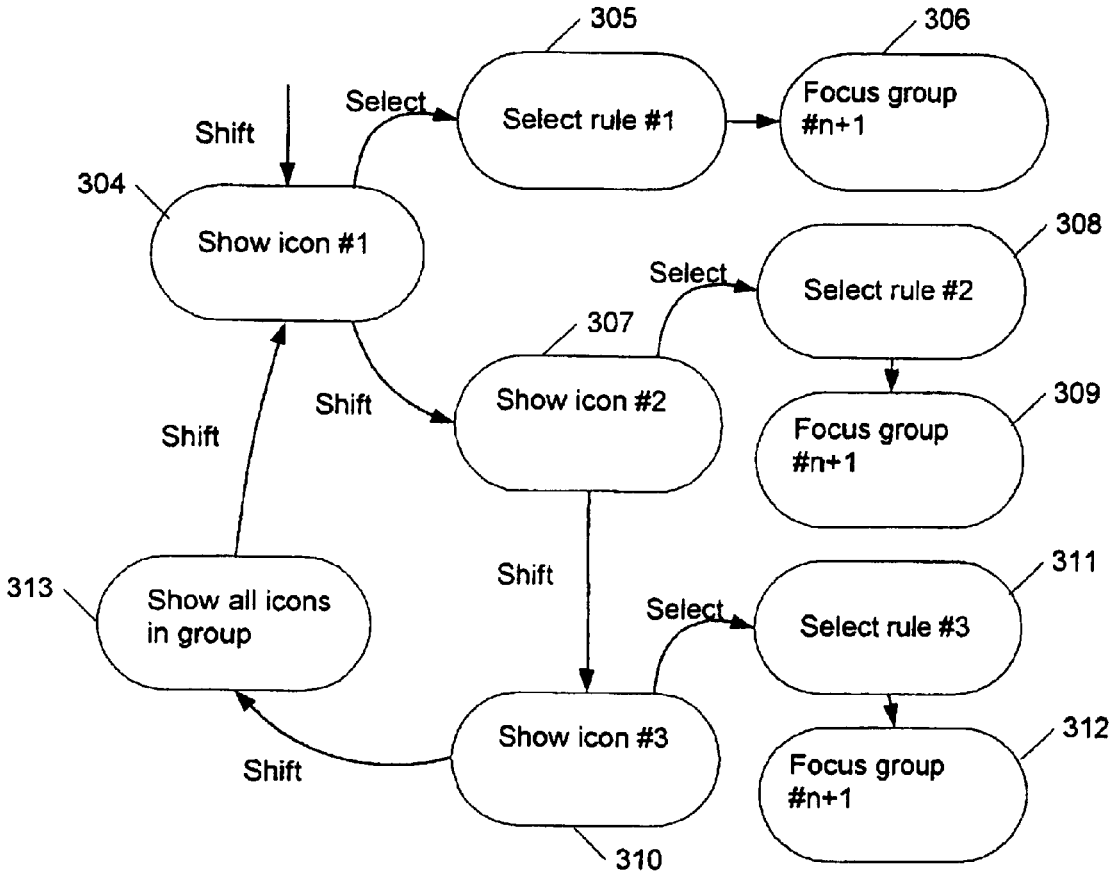

FIG. 3*b* shows a second diagram of a state machine for visual programming of a toy element. The state machine is caused to assume these states when the key "shift" is activated. It is assumed that a group of icons has been focused. When "shift" is activated, the state machine assumes the state 304 in which the first icon in the group which has been focused is activated—the other icons in the same group are not shown.

If the key "select" is activated, the state machine assumes the state 305 where "rule #1" is selected. "Rule #1" corresponds to a set of instructions for the microprocessor 102 which can perform a pattern of movement as shown on the icon "icon #1". Then the state machine assumes the state 306 where focus is moved from the current group of icons to another group of icons for the selection of an icon in this group.

Alternatively, if the key "shift" is selected in the state 304, the state machine assumes the state 307, where the "icon #2" is shown on the display—the other icons in the same group are not shown. Like in the state 304, it is possible in the state 307 to select a rule corresponding to the icon. This is done by activating the key "select", and then the state machine assumes the state 308 for the selection of the rule "rule #2". Subsequently, in state 309 focus is moved to the next group of icons.

Correspondingly, "icon #3" may be displayed in state 310 by activation of "shift". "Rule #3" may be selected by activation of "select", following which focus is moved to another group.

A further activation of "shift" in the state 310 causes all the icons in the group to be shown, and then the icons in the group are shown individually as described above.

In the states 306, 309 and 312, activation of the key "shift" will cause the state machine to assume one of the respective states 302 or 303 or 301.

It should be noted that it is also possible not to select a rule in one or more groups. In alternative embodiments, it can moreover be made possible to select several rules in the same group.

Additionally, it should be noted that this diagram corresponds to a display with just three icons in each group. This has been chosen to make the diagram readily understandable. In practice, there must be a number of states corresponding to the number of icons in a given group.

Generally, activation of the key "run" 114 will cause the state machine to assume a state in which a program is executed—irrespective of the number of selected rules. Thus, it is not necessary to ask the user whether the program is ready or not.

It is possible to jump to a desired group of icons in order just to change a rule in a user-specified program consisting of several rules.

Figure 3C:
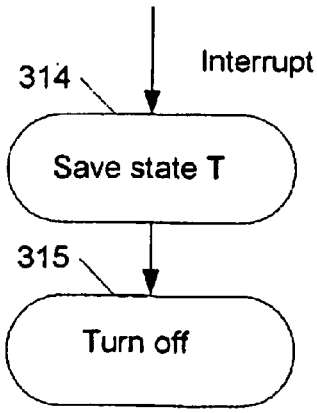

FIG. 3*c* shows a third diagram for the interruption of a state machine. This diagram shows how the state machine in state 314, upon activation of "interrupt", stores a representation of the state T in which the microprocessor/state machine is present. It is hereby possible to resume a suddenly interrupted programming course without having to start from scratch. The toy element is turned off in state 315.

Figure 3D:
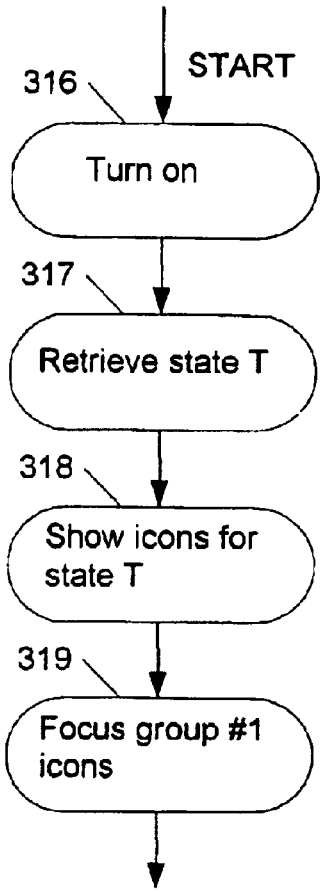

FIG. 3*d* shows a fourth diagram for starting a state machine. This diagram shows how the state machine, upon activation of "start", turns on the toy element in state 316. Then, a previously stored state representation T is retrieved in state 317. In state 318, the icons representing the state T are shown. In state 319, the icons in group 1 are focused, and then the state machine is ready for operation as described in connection with FIGS. 3*a*, 3*b* and 3*c*.

As will appear from the above description of FIGS. 3*a*, 3*b*, 3*c* and 3*d*, the user can program the toy element in a simple manner to execute programs which comprise complicated functions. The programs are generated by combining a number of specific rules.

The state machine described above may be implemented in a very compact manner. It is ensured hereby that sophisticated and user-specified functions can be performed in response to a simple dialogue with the user.

In the states where a rule is selected, that is the states 305, 308 and 311, the program system 119 executes a number of operations, thereby generating a user-specified program which can be executed by the microprocessor 102.

The user-specified program can be generated by storing a reference (that is a pointer) in the memory 121 which refers to a rule stored in the memory 120. When several rules are selected to be included in the same user-specified program, a list of references to rules in the memory 120 is stored in the memory 121. A user-specified program may thus comprise one or more rules.

Alternatively, the user-specified program may be generated by making a copy of each of the selected rules in the memory 120 and inserting the copies into the memory 121; the memory 121 will hereby contain a complete program. Furthermore, the user-specified program may be generated as a combination of references to rules and instructions to the microprocessor 102.

It should be noted that each rule typically comprises a set of instructions which may be considered a subprogram, a function or a procedure. But a rule may also just comprise modification of a parameter e.g. a parameter which indicates the speed of a connected motor or a time constant.

In an expedient embodiment of the invention, a given action may be performed when the state machine changes from a first state to a second state. An action may e.g. comprise signalling with sound and/or light to the user to indicate the state or type of state which the toy element has assumed.

Figure 4:
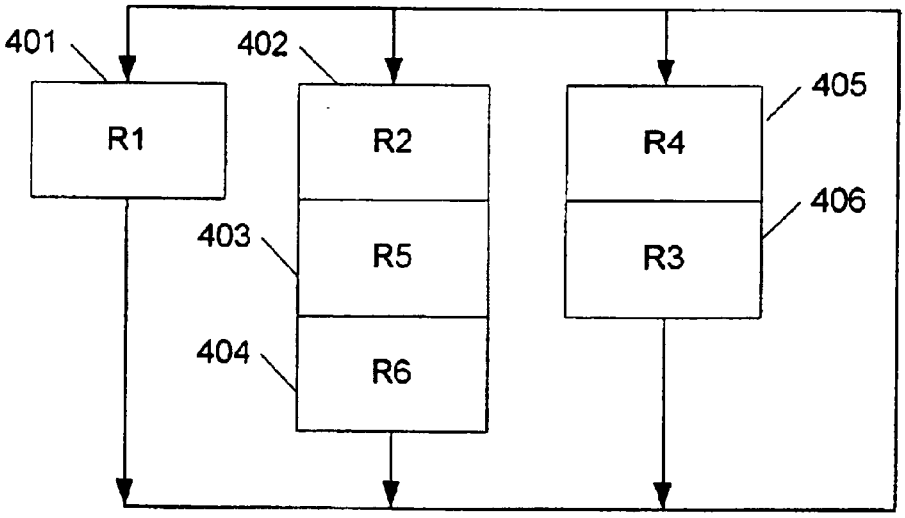
FIG. 4 shows parallel and sequential execution of programs.

FIG. 4 shows parallel and sequential execution of programs. When a user-specified program is generated, the rules may be executed as a sequence of rules, in parallel or in a combination of sequential and parallel program execution.

An example of two rules to be executed in parallel in time may be a first rule that a vehicle is to search for light, and a second rule that the vehicle is to change its direction when it detects obstacles.

An example of two rules to be performed sequentially in time may be a first rule that a vehicle is to drive straight ahead, and a second rule that the vehicle is to drive in a circular movement.

Rules R1 401, R2 402, R3 406, R4 405, R5 403 and R6 404 provide an example of a combination of sequential and parallel program execution.

When rules are executed as subprograms run in parallel in time, or in some form of time division between the subprograms, it must be possible to handle situations in which several rules want access to a resource e.g. in the form of a motor. In a preferred embodiment, such a situation is handled by allocating a priority number to each of the rules which may be selected. For example, rules within the same group of icons on the display may be given the same priority number. When the operating system 118 detects that two rules or subprograms both want access to a resource within a period of time, the rule having the lowest priority number is interrupted or stopped. The rule with the highest priority number is then allowed to use the resource. If only one rule can be selected from the same group of icons, a unique and predictable program execution of user-specified programs is thus achieved.

Figure 5:
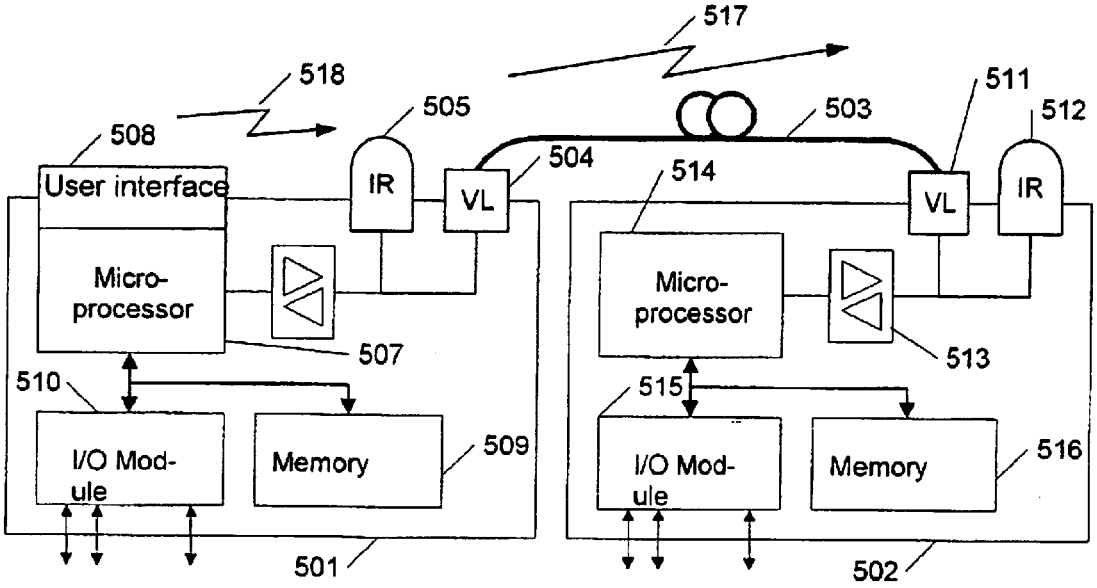
FIG. 5 shows first and second toy elements, where the first toy element can transfer data to the second toy element.

FIG. 5 shows first and second toy elements, where the first toy element can transfer programs to the second toy element. The first toy element 501 comprises a microprocessor 507, a I/O module 510, a memory 509 and a user interface 508. The toy element 501 moreover comprises a two-way communications unit 506 for communication via an infrared transmitter/receiver 505 or for communication by means of a light source/light detector 504 which can emit and detect visible light.

Correspondingly, the second toy element 502 comprises a microprocessor 514, a I/O module 515 and a memory 516. The toy element 502 moreover comprises a communications unit 513 for communication via an infrared transmitter/receiver 512 or for communication by means of a light source/light detector 511 which can emit and detect visible light.

In a preferred embodiment of the invention, the first toy element can both transmit and receive data, while the second toy element can only receive data.

Data can be transferred as visible light via a light guide 503. Alternatively, data may be transferred as infrared light 517 and 518. Data may be in the form of codes that indicate a specific instruction and associated parameters which can be interpreted by the microprocessors 507 and/or 514. Alternatively, data may be in the form of codes which refer to a subprogram or rule stored in the memory 516.

The I/O modules 510 and 515 may be connected to electronic units (e.g. motors) for control of these. The I/o modules 510 and 515 may also be connected to electronic sensors so that the units may be controlled in response to detected signals.

In a preferred embodiment, the fibre 503 is adapted such that part of the visible light transmitted by it escapes from the fibre. It is hereby possible for a user—directly—to watch the transmission. The user can e.g. see when the communication begins and stops.

The light through the fibre can transfer data with a given data transmission frequency as changes in the light level in the fibre. Data may be transmitted such that it is possible for the user to observe individual light level changes during a transmission (that is at a suitably low data transmission frequency), or merely by seeing whether the transmission is going on (that is at a suitably high data transmission frequency).

Generally, it is undesirable that part of the light to be transmitted through the fibre escapes from the fibre. But in connection with communication between two toy elements, it is a desired effect, since it is then possible to watch the communication in a very intuitive manner.

It is known to a skilled person how to ensure that part of the light escapes from the fibre. It can e.g. be done by imparting impurities to the sheath of the fibre, or by making mechanical notches or patterns in the fibre. The part of the light which is to escape from the fibre may also be controlled by controlling the ratio of the refractive index of a core to that of a sheath of a light guide.

Figure 6:
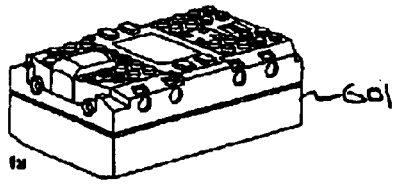
FIG. 6 shows a toy structure comprising a microprocessor controlled toy building element according to the invention coupled with generally known toy building elements.
Figure 6:
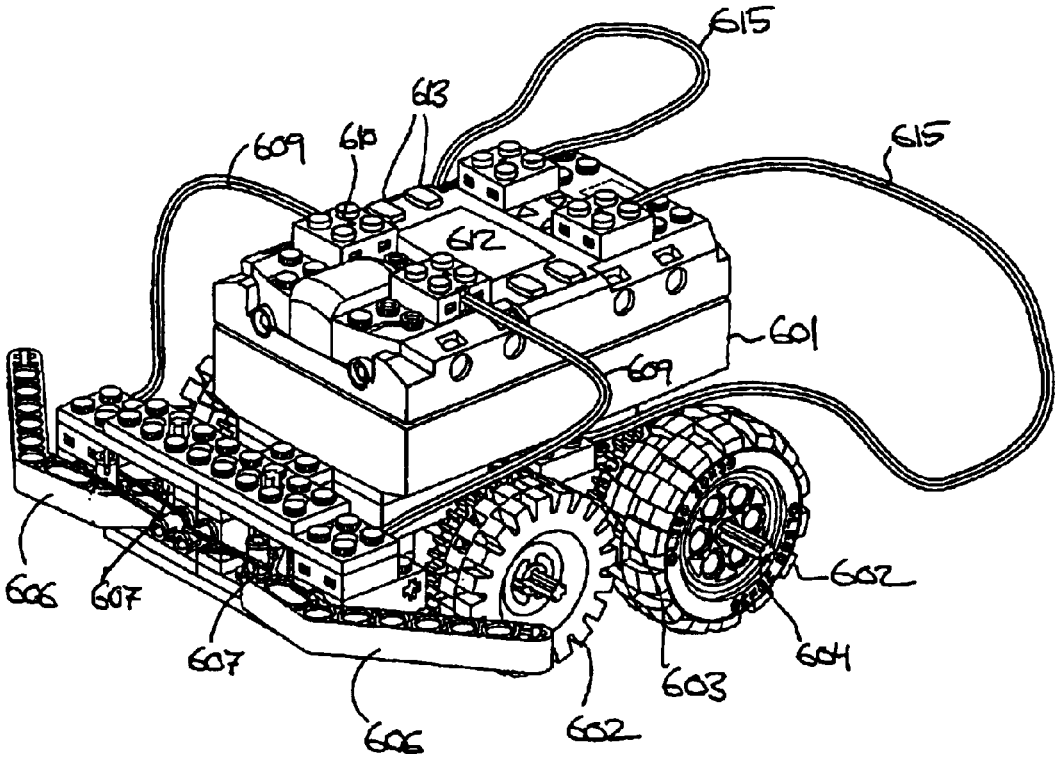

FIG. 6 shows a toy structure comprising a microprocessor controlled toy building element according to the invention coupled together with generally known toy building elements. The microprocessor controlled toy building element 601 is coupled on top of a structure 605 of building elements and two motors (not shown). The motors drive a wheel at each side of the vehicle, of which only the wheel 604 on one side of the toy structure is visible. The wheels are driven by a shaft 604 which is connected with the motor via gear wheels 603. The motors are electrically connected to the toy building element 601 by means of wires 615.

The toy structure moreover comprises two movable arms 606 which are pivotable about a bearing 607, so that the arms, when being pivoted, can be caused to affect a set of switches 608. The switches 608 are electrically connected to the toy element 601 via wires 609.

The toy element may be operated via the keys 613. The display 812 can show information, as described above in connection with FIG. 2. The toy element 601 has a set of electrical contact faces 610 and 611, to which the wires 609 and 615 may be connected for receiving signals and emitting signals, respectively.

By suitable programming of the toy element 601 the vehicle may be caused to drive round obstacles that may affect the arms 606.

What is claimed is:

1. A microprocessor controlled toy building element (101, 501) comprising a microprocessor (102, 507) which can execute instructions in the form of a program stored in a memory (117, 509);

a display (104, 508) integral within the toy building element (101, 501) to thereby form a single unit and adapted to display icons representing instructions to the microprocessor (102; 507);

coupling means for coupling with building elements that can be moved by maneuvering means, said maneuvering means being controllable in response to the instructions, the display (104, 508) comprises a plurality of icons (204, 205, 206, 207, 208) that are configured to illustrate patterns of movement, and which icons can be activated by a user for programming the microprocessor, and signalling with icons from the plurality of icons, said icons that are signalled with representing a pattern of movement followed by the toy building element.

2. A microprocessor controlled toy building element according to claim 1, characterized in that a type of icons (207, 208) is configured to illustrate modifications of patterns of movement.

3. A microprocessor controlled toy building element according to claim 1, characterized in that the toy comprises means for generating a first set of instructions comprising parameters upon activation of a first type of icons (204, 205, 206), which instructions and/or parameters may be modified by activation of a second type of icons (207, 208).

4. A microprocessor controlled toy building element according to claim 1, characterized in that a first group of rules is conditioned by a first group of signals, and that a second group of rules (R1–R6) is conditioned by a second group of signals.

5. A microprocessor controlled toy building element according to claim 1, characterized in that instructions corresponding to one icon implement one rule by controlling the maneuvering means in response to signals from electrical and/or electronic units.

6. A microprocessor controlled toy building element according to claim 1, characterized in that the microprocessor executes rules (R1–R6) in the form of instructions which control units, said rules being conditioned by a plurality of signals, said rules being arranged in an at least partly prioritized order, said prioritized order indicating which one of several rules is to be allowed to control a unit, said order being arranged according to the signals by which they are conditioned.

7. A microprocessor controlled toy building element according to claim 1, characterized in that the toy comprises keys (113, 114, 115) integrated in the toy, said keys being capable of activating the icons.

8. A microprocessor controlled toy building element according to claim 1, characterized in that the toy comprises communications means (505, 504) for receiving, commands which can be converted into a program that can be executed by the microprocessor.

9. A microprocessor controlled toy building element according to of claim 1, characterized in that the toy comprises communications means for transmission (505, 504) of commands.

10. A microprocessor controlled toy building element according to claim 1, characterized in that the toy comprises communications means (54) for transferring information via a light guide (503).

11. A microprocessor controlled toy building element according to claim 1, characterized in that the toy comprises an elongated light guide (503), through which visible light may be transmitted in its longitudinal direction, said light guide being adapted to allow part of the light transmitted to escape through its sides.

12. A toy building set according to claim 1, characterized by comprising toy building elements with coupling means for mutual coupling.

13. A microprocessor controlled toy building element (101, 501) comprising a microprocessor (102, 507) which can execute instructions in the form of a program stored in a memory (117, 509);

a display (104, 508) integral within the toy building element (101, 501) to thereby form a single unit and adapted to display icons representing instructions to the microprocessor (102; 507);

coupling means for coupling with building elements that can be moved by maneuvering means, said maneuvering means being controllable in response to the instructions, the display (104, 508) comprises a plurality of icons (204, 205, 206, 207, 208) that are configured to illustrate patterns of movement, and which icons can be activated by a user for programming the microprocessor, and signalling with icons from the plurality of icons, said icons that are signalled with representing a pattern of movement followed by the toy building element.

14. A microprocessor controlled toy building element according to claim 13, characterized in that a type of icons (207, 208) is configured to illustrate modifications of patterns of movement.

15. A microprocessor controlled toy building element according to claim 13, characterized in that the toy comprises means for generating a first set of instructions comprising parameters upon activation of a first type of icons (204, 205, 206), which instructions and/or parameters may be modified by activation of a second type of icons (207, 208).

16. A microprocessor controlled toy building element according to claim 13, characterized in that a first group of rules is conditioned by a first group of signals, and that a second group of rules (R1–R6) is conditioned by a second group of signals.

17. A microprocessor controlled toy building element according to claim 13, characterized in that instructions corresponding to one icon implement one rule by controlling the maneuvering means in response to signals from electrical and/or electronic units.

18. A microprocessor controlled toy building element according to claim 13, characterized in that the microprocessor executes rules (R1–R6) in the form of instructions which control units, said rules being conditioned by a plurality of signals, said rules being arranged in an at least partly prioritized order, said prioritized order indicating which one of several rules is to be allowed to control a unit, said order being arranged according to the signals by which they are conditioned.

19. A microprocessor controlled toy building element according to claim 13, characterized in that the toy comprises keys (113, 114, 115) integrated in the toy, said keys being capable of activating the icons.

20. A microprocessor controlled toy building element according to claim 13, characterized in that the toy comprises communications means (505, 504) for receiving commands which can be converted into a program that can be executed by the microprocessor.

21. A microprocessor controlled toy building element according to claim 13, characterized in that the toy comprises communications means for transmission (505, 504) of commands.

22. A microprocessor controlled toy building element according to claim 13, characterized in that the toy comprises communications means (54) for transferring information via a light guide (503).

23. A microprocessor controlled toy building element according to claim 13, characterized in that the toy comprises an elongated light guide (503), through which visible light may be transmitted in its longitudinal direction, said light guide being adapted to allow part of the light transmitted to escape through its sides.

24. A toy building set according to claim 13, characterized by comprising toy building elements with coupling means for mutual coupling.

25. A microprocessor controlled toy building element (101, 501) comprising a microprocessor (102, 507) integrated in the toy building element (101, 501) which can execute instructions in the form of a program stored in a memory (117, 509);

a display (104, 508) integrated in integral within the toy building element (101, 501) to thereby form a single unit and adapted to display icons representing instructions to the microprocessor (102; 507);

coupling means for coupling with building elements that can be moved by maneuvering means, said maneuvering means being controllable in response to the instructions, the display (104, 508) comprises a plurality of icons (204, 205, 206, 207, 208) that are configured to illustrate patterns of movement, and which icons can be activated by a user for programming the microprocessor, and signalling with icons from the plurality of icons, said icons that are signalled with representing a pattern of movement followed by the toy building element.

26. A microprocessor controlled toy building element according to claim 25, characterized in that the toy comprises means for generating a first set of instructions comprising parameters upon activation of a first type of icons (204, 205, 206), which instructions and/or parameters may be modified by activation of a second type of icons (207, 208).

27. A microprocessor controlled toy building element according to claim 25, characterized in that the microprocessor (102, 507) is adapted to receive signals from electrical and/or electronic units.

28. A microprocessor controlled toy building element according to claim 25, characterized in that instructions corresponding to one icon implement one rule by controlling the maneuvering means in response to signals from electrical and/or electronic units.

29. A microprocessor controlled toy building element according to claim 25, characterized in that the microprocessor executes rules (R1–R6) in the form of instructions which control units, said rules being conditioned by a plurality of signals, said rules being arranged in an at least partly prioritized order, said prioritized order indicating which one of several rules is to be allowed to control a unit, said order being arranged according to the signals by which they are conditioned.

30. A microprocessor controlled toy building element according to claim 25, characterized in that the toy comprises keys (113, 114, 115) integrated in the toy, said keys being capable of activating the icons.

31. A microprocessor controlled toy building element according to claim 25, characterized in that the toy comprises communications means (505, 504) for receiving, commands which can be converted into a program that can be executed by the microprocessor.

32. A microprocessor controlled toy building element according to of claim 25, characterized in that the toy comprises communications means for transmission (505, 504) of commands.

* * * * *